US011405726B2

(12) United States Patent
Tong

(10) Patent No.: US 11,405,726 B2
(45) Date of Patent: Aug. 2, 2022

(54) SOUND DEVICE

(71) Applicant: AAC Technologies Pte. Ltd., Singapore (SG)

(72) Inventor: Dijiang Tong, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 460 days.

(21) Appl. No.: 16/705,169

(22) Filed: Dec. 5, 2019

(65) Prior Publication Data

US 2020/0213739 A1 Jul. 2, 2020

(30) Foreign Application Priority Data

Dec. 28, 2018 (CN) ..... 201822239685.1

(51) Int. Cl.
*H04R 7/02* (2006.01)
*H04R 1/02* (2006.01)

(52) U.S. Cl.
CPC ..... *H04R 7/02* (2013.01); *H04R 1/026* (2013.01)

(58) Field of Classification Search
CPC ..... H04R 7/02; H04R 1/026
USPC ..... 181/171
See application file for complete search history.

(56) References Cited

U.S. PATENT DOCUMENTS

2005/0018869 A1* 1/2005 Ajiki ..... H04R 31/006 381/394
2017/0134848 A1* 5/2017 Shao ..... H04R 7/18
2020/0045488 A1* 2/2020 Wang ..... H04R 31/006

* cited by examiner

*Primary Examiner* — Sean H Nguyen
(74) *Attorney, Agent, or Firm* — W&G Law Group

(57) ABSTRACT

The present invention provides a sound device, which includes a housing and a sound unit with a diaphragm. The housing includes a cover plate and a bottom plate, the cover plate and the bottom plate are matched to form an accommodating cavity, and the sound unit is fixedly placed in the accommodating cavity. The bottom plate includes a main plate and a steel sheet embedded in the main plate, the main plate is provided with a first opening, the steel sheet is fixedly connected with the main plate and covers the first opening, and one side of the sound unit away from the diaphragm is welded and fixed with the steel sheet.

8 Claims, 2 Drawing Sheets

SOUND DEVICE

TECHNICAL FIELD

The present disclosure relates to an electroacoustic transducer, and more particularly, to a sound device.

BACKGROUND

In order to avoid vibration of a housing of an existing sound device, a foam is generally attached to a back of a unit, to make the unit be connected with a bottom housing through the foam. However, on one hand, the attached foam occupies a height space of the sound device, and on the other hand, the foam has a poor thermal conductivity, which is not beneficial for the sound device to dissipate heat.

Figure 1:
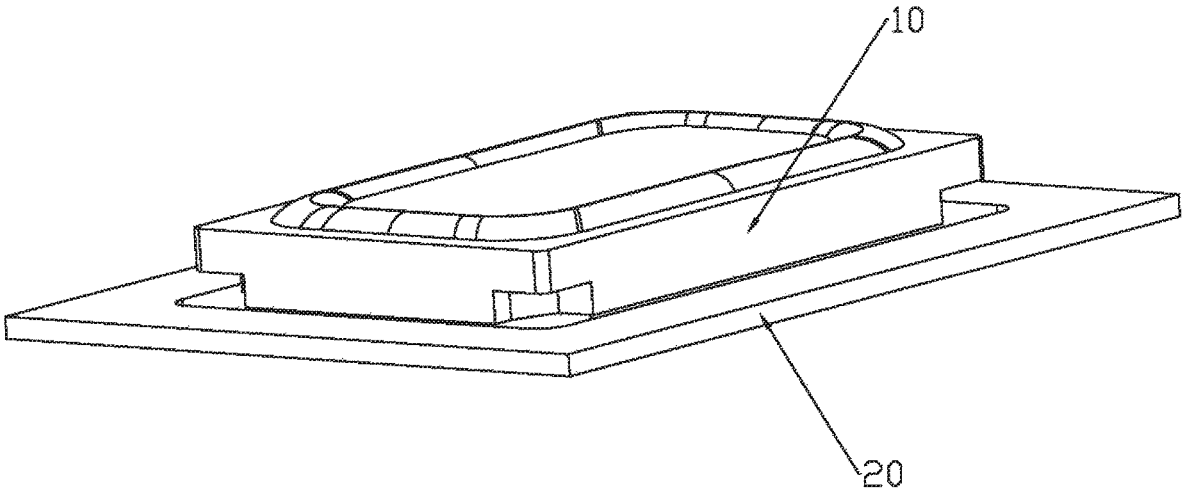
FIG. 1 is a structure diagram of a bottom plate and a sound unit of a sound device according to the present disclosure.

Reference numerals in the drawings are as follows:

10 refers to sound unit;
20 refers to bottom plate;
21 refers to main plate;
22 refers to steel sheet;
221 refers to bottom wall;
222 refers to bent portion;
30 refers to recess; and
40 refers to cover plate.

DETAILED DESCRIPTION

It should be noted that embodiments in the present application and features in the embodiments can be combined with each other without conflicts. The present disclosure will be described in detail hereinafter with reference to drawings and the embodiments.

It should be pointed out that the following detailed description is exemplary and is intended to provide further description to the present application. Unless otherwise specified, all technical and scientific terms used herein have the same meaning as commonly understood by those of ordinary skills in the technical field which the present application belongs to.

It should be noted that the terms herein are used for the description of the specific embodiments only rather than limit the exemplary embodiments according to the present application. As used herein, the singular form is also intended to include the plural form unless otherwise indicated in the context clearly, and furthermore, it should be understood that when the terms "contain" and/or "comprise" are used in the description, the terms indicate the presence of features, steps, operations, devices, components, and/or combinations thereof.

Now, the exemplary embodiments according to the present application will be described in detail with reference to FIG. 1 to FIG. 2. A sound device includes a housing and a sound unit 10 with a diaphragm. The housing includes a cover plate 40 and a bottom plate 20, the cover plate 40 and the bottom plate 20 are matched to form an accommodating cavity, and the sound unit 10 is fixedly placed in the accommodating cavity. The bottom plate 20 includes a main plate 21 and a steel sheet 22 embedded in the main plate 21, the main plate 21 is provided with a first opening, the steel sheet 22 is fixedly connected with the main plate 21 and covers the first opening, and one side of the sound unit 10 away from the diaphragm is welded and fixed with the steel sheet 22.

In the technical solution, the bottom plate 20 and the cover plate 40 are matched to form the accommodating cavity, and the sound unit 10 is fixedly placed in the accommodating cavity. The bottom plate 20 includes the main plate 21 and the steel sheet 22, and the steel sheet 22 is fixed with the main plate 21 in an embedded manner; and the main plate 21 is provided with the first opening, and the steel sheet 22 is placed in the first opening. According to the technical solution, the steel sheet 22 is directly connected with one side of the sound unit 10 away from the diaphragm in a welding fixing manner, and preferably, the steel sheet 22 and the sound unit 10 are fixed by spot welding, so that the welding can be performed in a short time, with a good welding quality and a high production efficiency. According to the technical solution in the present disclosure, a vibration problem of the housing of the sound device can be solved on one hand, and a height of the sound device can be reduced on the other hand, thus being beneficial for the sound device to dissipate heat.

Figure 2:
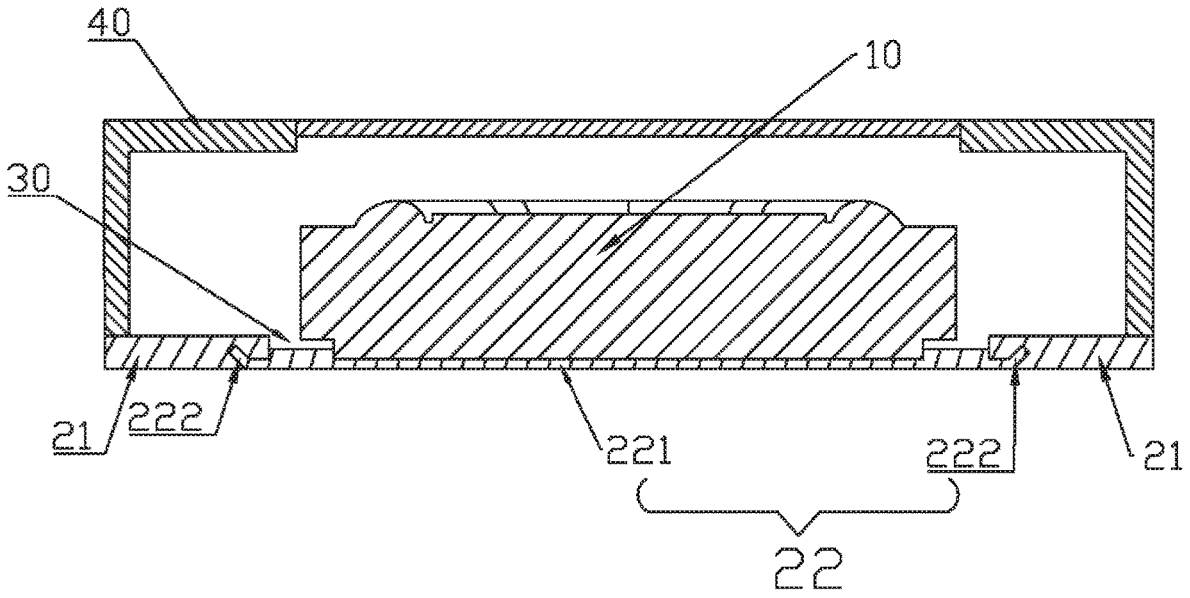
FIG. 2 is a sectional view of the sound device according to the present disclosure.

As shown in FIG. 2, the first opening penetrates through the main plate 21, an inner wall surrounding the first opening is correspondingly formed on the main plate 21, the steel sheet 22 is placed in the first opening, and is matched with the inner wall to form a recess 30, and the sound unit 10 is placed in the recess 30, and welded and fixed with the steel sheet 22. The sound unit 10 is positioned and welded through the recess 30 formed by the steel sheet 22 and the inner wall, which is beneficial to improving a welding quality, and in addition, a height of the sound device is reduced and an application range of the sound device is expanded.

Preferably, the steel sheet 22 includes a bottom wall 221 and a bent portion 222, the bottom wall 221 is used for fixing the sound unit 10, and the bent portion 222 is formed by bending an edge of the bottom wall 221 towards the cover plate 40, and is used for fixing the bottom wall 221 and the main plate 21. Connection between the steel sheet 22 and the main plate 21 is firmer and more stable through the fixing manner that the bent portion 222 is embedded in the main plate 21, that is, the sound unit 10 is ensured to be stably fixed on the bottom plate 20. Further, the steel sheet 22 and the main plate 21 are integrally injection-molded. The vibration problem of the housing of the sound device in existing technologies is solved by the connection manner in which the steel sheet 22 and the main plate 21 are integrally injection-molded and the fixing manner in which the sound unit 10 and the steel sheet 22 are welded.

In order to make the sound device work normally, the cover plate 40 is provided with a sound hole corresponding to the diaphragm, and preferably, the sound hole can be arranged on a side surface of the cover plate 40.

According to the present disclosure, the sound unit 10 is fixed in the accommodating cavity formed by the cover plate and the bottom plate 20, the main plate 21 is provided with the first opening, the steel sheet 22 is fixedly placed on the first opening, the steel sheet 22 and the main plate 21 are integrally injection-molded through the bent portion 222, and the steel sheet 22 and the inner wall of the main plate 21 form the recess to position the sound unit 10. Finally, one side of the sound unit 10 away from the diaphragm is fixed with the first steel sheet 22 by spot welding. The vibration problem of the housing of the sound device is solved, and in addition, the height of the sound device is reduced, thus being beneficial for the sound device to dissipate heat.

The description above is merely embodiments of the present disclosure, and it should be pointed out that, those of ordinary skills in the art can make improvements without departing from the inventive concept of the present disclosure, but these all falls into the scope of protection of the present disclosure.

What is claimed is:

1. A sound device, comprising a housing and a sound unit with a diaphragm, wherein the housing comprises a cover plate and a bottom plate, the cover plate and the bottom plate are matched to form an accommodating cavity, and the sound unit is fixedly placed in the accommodating cavity; wherein the bottom plate comprises a main plate and a steel sheet embedded in the main plate, the main plate is provided with a first opening, the steel sheet is fixedly connected with the main plate and covers the first opening, and one side of the sound unit away from the diaphragm is welded and fixed with the steel sheet.

2. The sound device according to claim 1, wherein the first opening penetrates through the main plate, an inner wall surrounding the first opening is correspondingly formed on the main plate, the steel sheet and the inner wall form a recess, and the sound unit is placed in the recess, and welded and fixed with the steel sheet.

3. The sound device according to claim 2, wherein the cover plate is provided with a sound hole corresponding to the diaphragm.

4. The sound device according to claim 2, wherein the steel sheet comprises a bottom wall fixing the sound unit and a bent portion bent and extending from an edge of the bottom wall and fixed with the inner wall, and the bent portion is bent towards the cover plate.

5. The sound device according to claim 4, wherein the cover plate is provided with a sound hole corresponding to the diaphragm.

6. The sound device according to claim 1, wherein the steel sheet and the main plate are integrally injection-molded.

7. The sound device according to claim 6, wherein the cover plate is provided with a sound hole corresponding to the diaphragm.

8. The sound device according to claim 1, wherein the cover plate is provided with a sound hole corresponding to the diaphragm.

* * * * *